United States Patent [19]

Haug

[11] Patent Number: 4,520,725

[45] Date of Patent: Jun. 4, 1985

[54] SETTING MECHANISM FOR TYPE WHEELS OF A PRINTING DEVICE

[75] Inventor: Werner Haug, Langnau, Switzerland

[73] Assignee: Frama AG., Switzerland

[21] Appl. No.: 536,763

[22] Filed: Sep. 28, 1983

[30] Foreign Application Priority Data

Oct. 4, 1982 [CH] Switzerland ..... 5827/82

[51] Int. Cl.[3] ..... B41L 47/46; B41J 1/34

[52] U.S. Cl. ..... 101/91; 101/45; 101/85; 101/99; 101/110

[58] Field of Search ..... 101/45, 79, 85, 91, 101/99, 110, 86–89

[56] References Cited

U.S. PATENT DOCUMENTS 2,510,350 6/1950 Rouan et al. ..... 101/91
3,916,785 11/1975 Burger et al. ..... 101/110
3,939,767 2/1976 Belge ..... 101/110
4,050,374 9/1977 Check, Jr. ..... 101/110
4,140,054 2/1979 Martin et al. ..... 101/91

*Primary Examiner*—Edgar S. Burr
*Assistant Examiner*—David A. Wiecking
*Attorney, Agent, or Firm*—McGlew and Tuttle

[57] ABSTRACT

The type wheels provided on a postage or franking head of a postage meter or franking machine are adjusted in stepwise manner from outside the franking head by means of adjusting push rods, which in each case engage a pinion associated with a type wheel. The engagement and adjusting movement of the adjusting push rod is performed by electromagnets. The engagement movement takes place by pivoting a guide plate carrying the adjusting push rods, on which the rods are displaceable by means of the electromagnet counter to the tension of a tension spring. The electromagnets can be energized on the basis of an electrical pulse, which is simultaneously used for adjusting an electronic display, provided on the franking machine casing.

18 Claims, 14 Drawing Figures

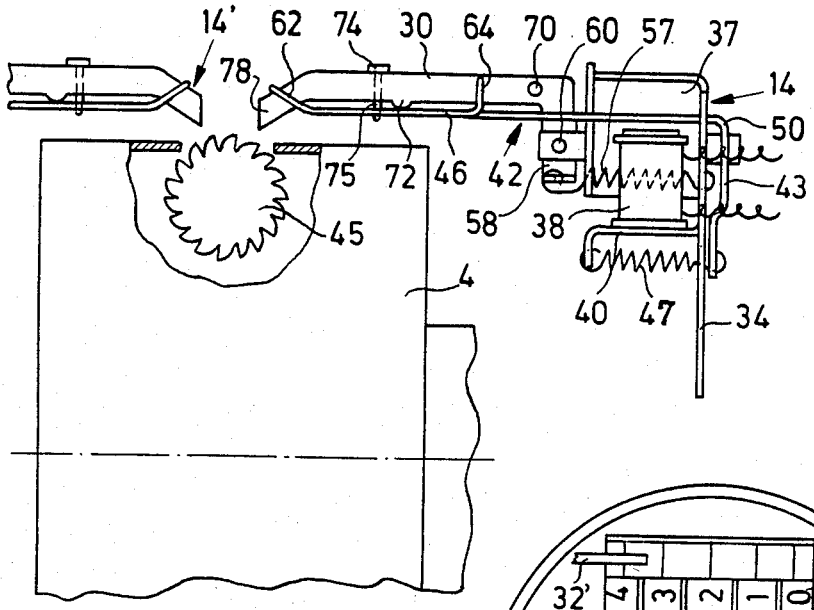
FIG. 2
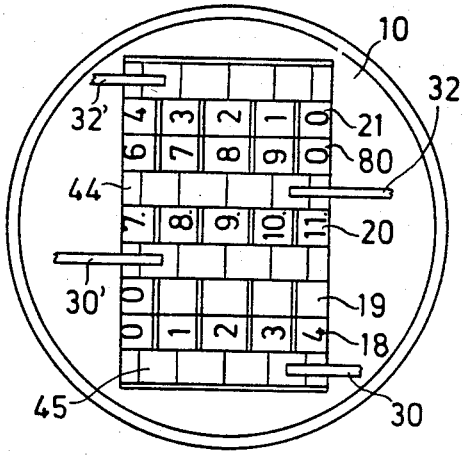
FIG. 4
FIG. 3
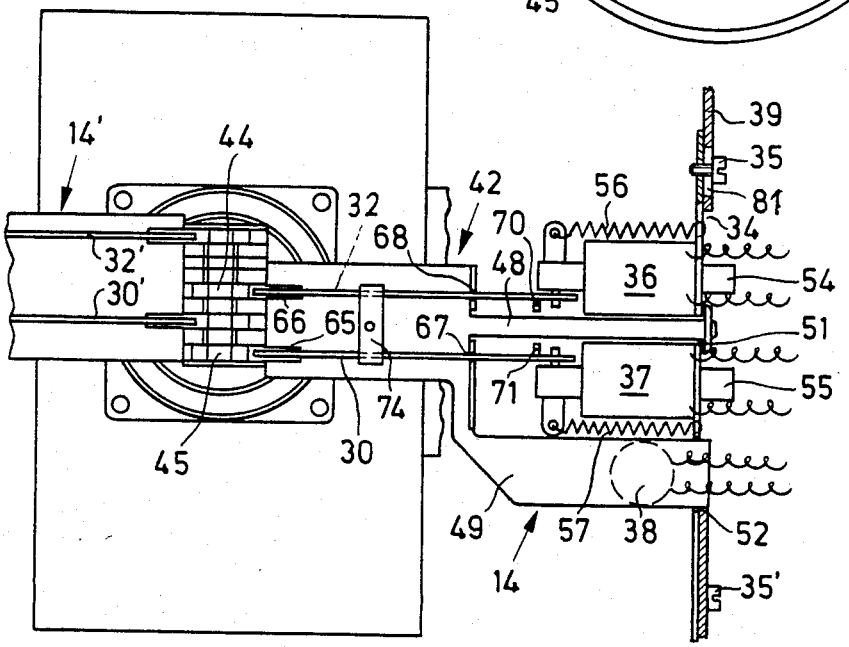

SETTING MECHANISM FOR TYPE WHEELS OF A PRINTING DEVICE

FIELD AND BACKGROUND OF THE INVENTION

The present invention relates in general to printing devices such as postage meters, and in particular to a new and useful setting mechanism for the type wheels of such printing devices.

In the presently conventionally used postage meters (or so called franking machines), e.g. the "FRAMA Mod. 100 electronic" of the assignee of the present application, there is a setting mechanism for each type wheel and this is formed from numerous difficult to manufacture and hard to fit components. Each setting mechanism has a rack extending longitudinally through the drive shaft of the franking head, which on the one hand engages with the pinion of the type wheel and on the other with a toothed gear of an adjusting disk rotating with the shaft. On setting the type wheel, a manually operated setting lever is engaged with the adjusting disk and is pivoted about an angle corresponding to the numerical value. By means of the toothed gear arranged in the adjusting disk, this pivoting movement brings about a displacement of the rack and consequently a rotation of the type wheel into the desired setting position. On discontinuing the engagement between the adjusting disk and the setting lever, the setting position in the adjusting disk is secured by stop means. In addition, the adjusting disk is provided with mechanical means, which mechanically operate a counter during each rotation of the franking head and consequently the adjusting disk, said counter counting the value units used up during posting or franking. Details concerning the mechanism used can be gathered e.g. from the spares catalog for the aforementioned machine type.

It has already been proposed to carry out the mechanical adjuting movement in an electromotive manner, but the use of servomotors has led to an even more complicated and voluminous mechanism. However, the use of electrical drives has the advantage that the input of the set values can take place electronically, e.g. also as a function of the electrical signal of a weighing device, because the franking value to be set is also dependent on the weight of the letter or the like to be franked or posted. The electronic input of the set positions for the type wheels also has the advantage that the number of value units used up by the franking operation can be stored in an electronic counter instead of a mechanical counter with reduced expenditure and effort.

As a result of the known purely mechanical setting mechanism for type wheels, it is only possible to set type wheels of a single printing block, i.e. the block for the franking value. The second printing block for the date, normally provided on the circumference of the franking head, must be adjusted manually by means of a tool or by means of a separate so-rotating mechanism after opening the casing cover or flap.

SUMMARY OF THE INVENTION

The problem to be solved by the present invention is to provide a setting mechanism for type wheels, which can be more easily manufactured and fitted as a result of a mechanically simpler construction and which is particularly suitable for a combination with an electronic input and an electronic storage for the recording of the type wheel position set over a certain time.

Accordingly an object of the present invention is to provide a setting mechanism for a printing devicep having a plurality of rotatably mounted type wheels each with a pinion, comprising, a support, at least one push rod associated with one of the pinions, reciprocally mounted to the support for rotating the one pinion by an incremental amount in stepwise fashion during each reciprocation and an electromagnet connnected to the support and having a movable part engaged with the at least one push rod for reciprocating the push rod.

A further object of the invention is to provide such a setting mechanism in a franking machine or postage meter wherein a plurality of push rods are provided for a plurality of the type wheels, a rack slidably mounted in the printing device and engaged with each of the type wheels and the push rods engaged with each rack.

A further object of the invention is to provide a setting mechanism for printing devices, and in particular postage meters, which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the Drawings:

FIG. 2 is a partial side elevational view of the setting mechanism with parts of the franking head cut away;

FIG. 3 is a top plan view of the setting mechanism according to FIG. 2 and the franking head;

FIG. 4 is a larger-scale view of a group of type wheels with their toothed gears and with partly shown adjusting push rods of two setting mechanisms;

DESCRIPTION OF PREFERRED EMBODIMENTS

Figure 1:
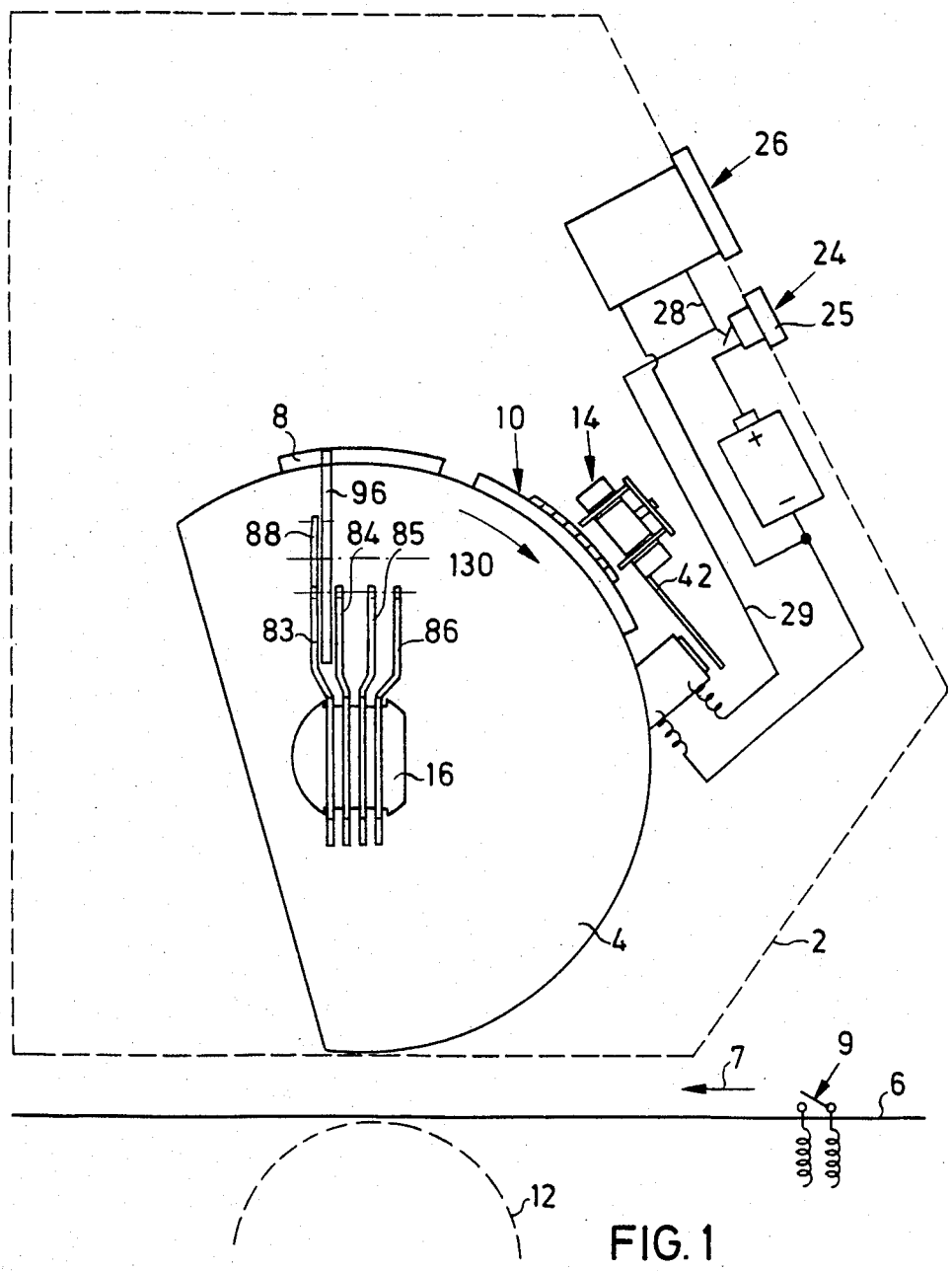
FIG. 1 is a side elevational view of a franking machine, in accordance with one embodiment of the invention, in the vicinity of the franking head with an end view of a setting mechanism for two type wheels in diagrammatic form.
Figure 12:
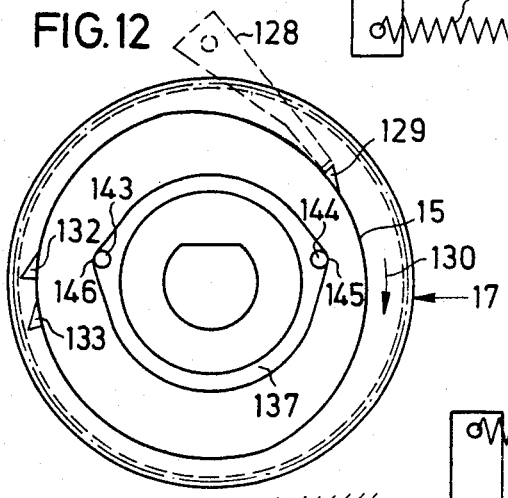
FIG. 12 is a left-hand side elevational view of the control wheel according to FIG. 11.

In FIG. 1, the dotted lines 2 indicate the casing part of the franking machine or postage meter which is located laterally of a main casing (not shown) and which encloses the franking or posting head 4. The general construction of a franking machine is considered to be known. An example is provided by the often used machine of the present Applicant called the "FRAMA Mod. 100 electronic". The franking head is located above a franking table 6 which envelopes are moved in the direction of arrow 7 for printing with the franking or postage value and the date. The franking head 4 rotates in accordance with the working cycle of the franking machine, which is started by a contact switch 9 arranged in the franking table and operated by the supply of an envelope, so that the block 8 for the franking value and the block 10 for the date roll over the envelope (not shown). Pressure is applied through the automatic lifting movement of a pressure roller 12, indicated by a broken line. The lifting movement results from a lever movement of a drive transmission (not shown), which is started by the rolling of a control roll 13, indicated by broken lines in FIG. 5, on a cam 15 of control wheel 17 (FIG. 12). By means of an ink storing roller (not shown), ink is transferred by a rolling movement onto blocks 8 and 10. A corresponding means forms the subject matter of European Patent Application No. 0,064,125.

A first example of the setting mechanism according to the invention on a franking machine relates to the adjustment of the type wheels of the date block 10 by setting mechanisms 14, 14' acting from the circumference of the franking head, as shown in FIGS. 1 to 4.

The setting mechanism for type wheels 18 to 21 of date block 10, shown on a larger scale in FIG. 4, has an input device 24, which has a plurality of keys 25, which are simultaneously used for setting the figures of an electronic date display 26. The operation of a key 25 releases an electrical pulse which, by lines 29, 28, is supplied both to the date display 26 and to the electromechanical setting mechanism 14 for type wheels 18 to 21, as is diagrammatically illustrated by the circuit of FIG. 1.

The setting mechanism 14, 14' has an adjusting push rod 30, 32 or 30', 32"for each type wheel to be adjusted. As shown in FIGS. 2 and 3, a setting mechanism 14, 14' can be provided on either side of the date block 10 or the franking head 4. As these setting mechanisms 14, 14' can be identical, only setting mechanism 14 is described hereinafter.

The setting mechanism has for example a vertically directed mounting plate 34, which is rigidly fixed, e.g. by means of screws 35, 35' to an inner wall 39 of the franking machine. positioned alongside the franking head. This mounting plate 34 carries at least two and in the present case three electromagnets 36 to 38. Electromagnets 36, 37 are used for actuating the adjusting push rods 32, 30 and are directly fixed in parallel to the plate. The third electromagnet 38 is fixed to a bent part 40 bent vertically out of the mounting plate and is therefore directed at right angles to the two other magnets 36, 37. The third electromagnet 38 is used for pivoting a guide plate 42, on which slides the adjusting push rods 30, 32, into a position in which push rods 30, 32 can engage with a toothed gear 44, 45 for adjusting a type wheel 20 or 18. In side view (FIG. 2), guide plate 42 is rectangular, its shorter leg 43 running parallel to mounting plate 34 and carrying at its free end a tension spring 47, whose other end is fixed to the bent part 40 of mounting plate 34. Thus, tension spring 47 maintains guide plate 42 in the waiting position shown in FIG. 2, in which the adjusting push rods 30, 32 are held spaced from franking head 4, so that the latter can rotate in unimpeded manner for franking purposes. The longer guiding leg 46 of guide plate 42 is forked in the manner shown in FIG. 3 and the ends of both fork legs 48, 49, in the vicinity of the bent part 50 of guide plate 42, are mounted in upwardly open cutouts 51, 52 of mounting plate 34, so that guide plate 42 can pivot about this bearing point. The third electromagnet 38 is provided for the pivoting movement of guide plate 42 and draws the longer leg 46 or its fork leg 49 (FIG. 3) downwardly, counter to the tensile force of return spring 47, so that with guide plate 42, and adjusting rods or slides 30, 32, move into a pivoting position in which, following longitudinal displacement by means of electromagnets 36, 37, they can rotate the adjusting gear 44, 45 of a type wheel.

Electromagnets 36, 37 have an armature shaft 54, 55 which can extend through the field coil onto whose one end is fixed in hinged manner the bent leg 58 of the associated adjusting push rod 30 or 32. On exciting electromagnets 36, 37, the armature shaft 54, 55 moves counter to the tension of a tension spring 56, 57 fixed to one end thereof and out of the field coil, thereby forwardly displacing adjusting push rod 30 or 32 in the direction of the rotary movement of wheel or grear 44 or 45. The hinge joints 60 between armature shaft 54 or 55 and the bent leg 58 of the adjusting slide makes it possible for adjusting push rods 30, 32 to pivot together with guide plate 42.

For the lateral guidance of adjusting push rods 30, 32 on guide plate 42, the plate 42 is provided with an upwardly sloping being front end 62, as well as centrally with a vertically upwardly bent plate part 64, each of which has a slot 65 to 68, which encloses adjusting push rods 30 or 32, which are punched from sheet metal. Part 64, bent upwardly at a right angle from guide plate 42 is also used as a stop for the longitudinally directed lifting movement of the adjusting push rods, in that the rods have a stop pin 70, 71. A sliding can 72 is shaped onto the bottom of adjusting push rods 32, 30 and with the aid of said cam the latter slide on the top of guide plate 42. So as to hold adjusting push rods 30, 32 in an upwardly displaceable manner on guide plates 42, a small cover plate 74 is fixed by means of a bolt 75 at the appropriate point spaced from the guide plate.

Electromagnets 38 and 36 must be excited in order to e.g. rotate type wheel 20 for the indication of months of date block 10 by one index from month 9 to month 10. The exciting current is released by depressing one of the keys 25 (FIG. 1). The unit comprising guide plate 142 and adjusting push rods 30, 32 firstly pivots downwardly and consequently so does the tip of adjusting push rods 30, 32 intended for engaging in gear 44 until it enters a plane touching the pitch circle of gear 44 or 45. After exciting electromagnet 36, adjusting push rods 32 move forwardly so that adjusting tip 78 engages in a tooth of the gear and rotates gear 44 and the type wheel 20 fixed thereto by a specific angle. In accordance with FIG. 4, only type wheels 18 to 21 are coupled to an adjusting gear, with which is associated an adjusting push rod, while type wheel 80 for setting decades has no adjusting gear, because it only has to be adjusted every ten years, and this can be performed manually with a sharp tool, after opening a cover in the franking machine casing, positioned in the vicinity of the franking head.

In place of the manual release of the setting mechanism for the type wheels through the operation of keys 25, it can also be automatically released by a battery-operated clock with a date reading operation.

The setting mechanism is preferably circumferentially fixed relative to the franking head. This adjustability makes it possible to accurately align the position of adjusting push rods 30, 32 with the adjusting gears 44, 45 following the replacement of block 10 by another block. The use of different blocks, e.g. on a franking machine, is necessary with an otherwise identical construction of said machine, in order to adapt to different requirements, e.g. if the machine must be adapted at another place or in another country to different requirements for specifications relative to franking (posting). The group of date type wheels on the franking head can assume a different position in the circumferential direction. The setting mechanism 14, 14' can easily be adjusted in that the screws 35, 35' which fix the mounting plate 34 to the inner wall 39 of the franking machine, extend through an elongated opening or slot 81, which is either in the inner wall of the machine, or in the mounting plate, so that the screw can assume various clamping positions in said opening 81.

For circumferentially adjusting the setting mechanism 14, 14' relative to the franking head, it is also possible to use a setting mechanism (not shown), which is operated manually or by means of a drive and which can be provided with electronic control means. As a result of such a setting mechanism, it is possible to adjust the setting mechanism circumferentially relative to the franking head, to such an extent that the same actuating mechanism, by corresponding circumferential movement, can be used, as desired, for operating the type wheels or their gears of several blocks 8, 10. In accordance with FIG. 1, such a setting mechanism can move setting mechanism 14 from its position in FIG. 1 over block 10 into a position where it is located over block 8. The guidance of this circumferential movement of the setting mechanism can take place in a slot concentric to the franking head circumference by means of guide rails or the like.

The embodiment of a franking machine with setting mechanism according to the invention and described hereinafter relative to FIGS. 1 and 5 to 13, represents an example for such special features. These setting mechanism have an apparatus part having an identical construction to one of the setting mechanisms 14, 14' described hereinbefore, in accordance with FIGS. 1 to 3, but each setting mechanism additionally has a rack adjusting slide 83 to 86, which is mechanically positioned between the adjusting pinion 88 of a type wheel and an adjusting push rod 89 or 90. Adjusting push rods 89, 90 correspond to adjusting push rods 30, 32 or 30', 32' of the previously described setting mechanisms 14, 14' and are consequently only partly shown in FIG. 5.

Figure 9:
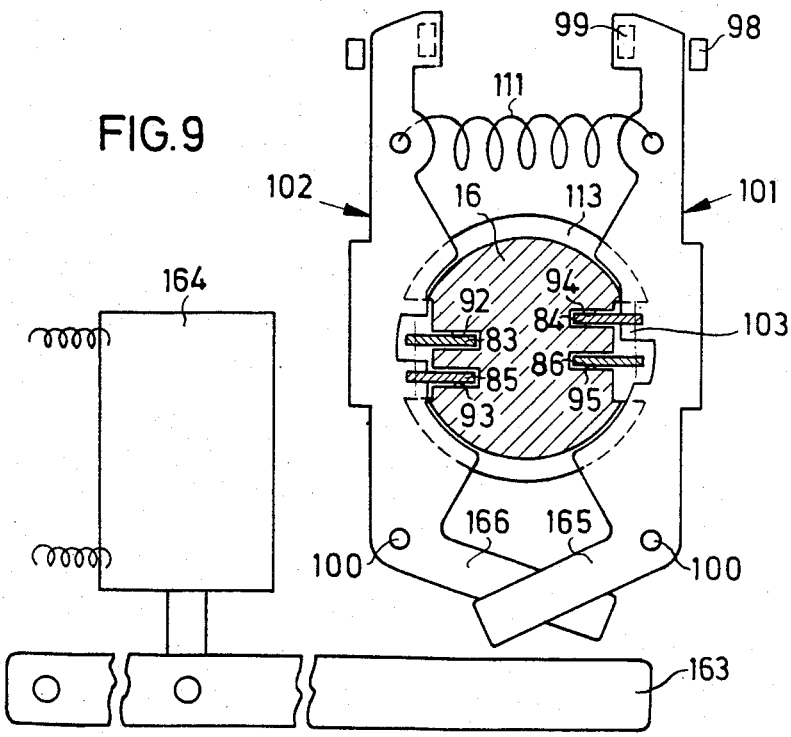
FIG. 9 is a cross-sectional view through the franking machine shaft at IX—IX of FIG. 5, with a pair of detents, in the engaged position.

Adjusting slides 83 to 86 are guided in the franking machine shaft 16, for which purpose it is provided with externally open guide slots 92 to 95, as can best be seen in FIG. 9.

Figures 5, 5A:
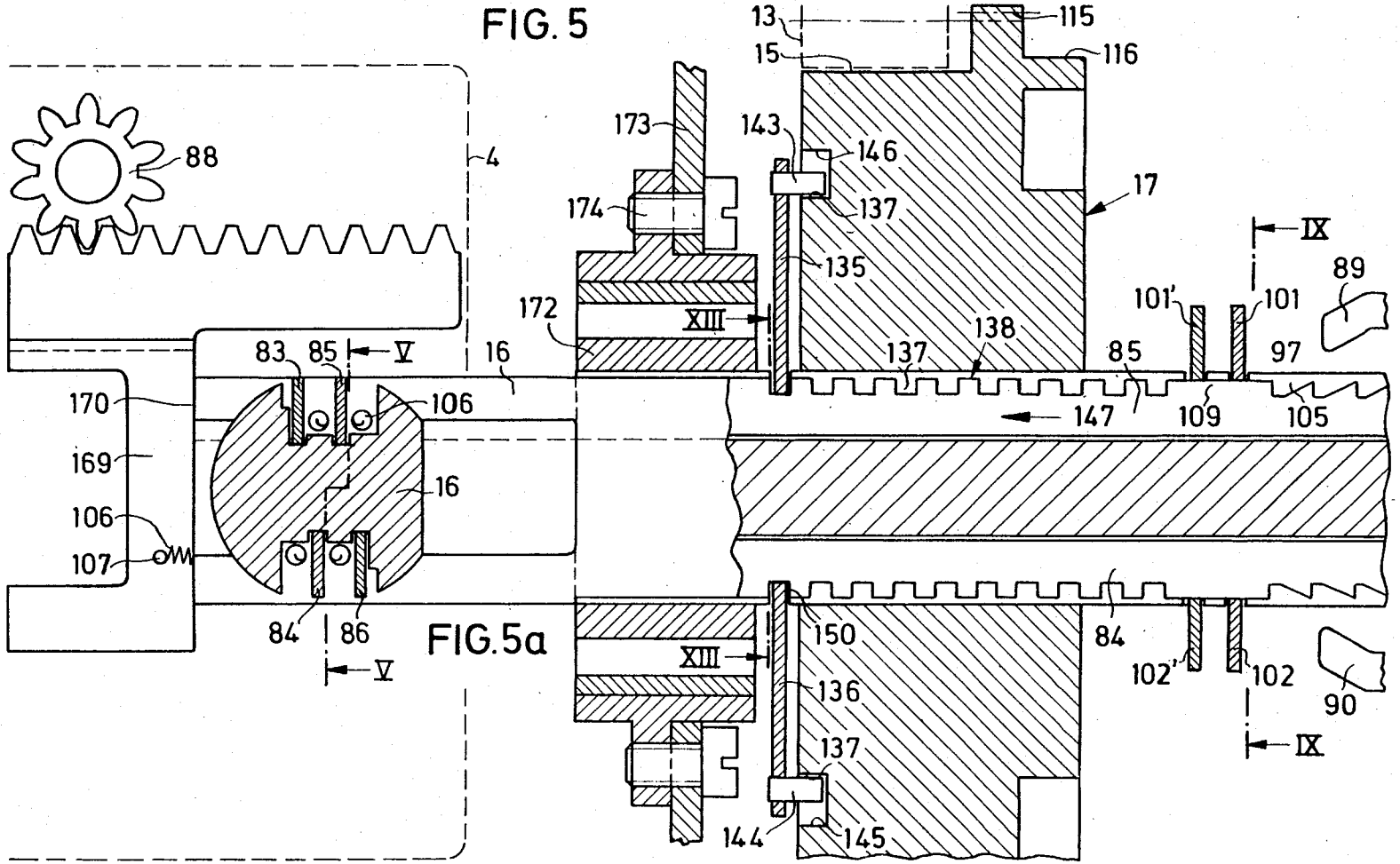
FIG. 5 is a partial sectional view through a franking machine along its shaft in the vicinity of the control wheel and the franking head in accordance with the invention.
FIG. 5*a* is a sectional representation of the shaft for the franking head of FIG. 5.

For a four-figure number of the franking value, in the block 8 according to FIG. 1, four type wheels 96 are juxtaposed in parallel in franking head 4, whereof only one is shown in order to simplify the representation of FIG. 1. Correspondingly, there are four juxtaposed electric input keys corresponding to keys 25 according to FIG. 1. As in the case of the previously described rotation of pinion 45 according to FIG. 2, whenever key 25 is depressed, the particular adjusting slide 83 to 86 is advanced by the distance between the teeth, so that correspondingly pinion 88 and type wheel 96 can rotate by a further place value or one tooth. Thus, for setting number 4, key 25 for the particular place value must be successively depressed four times. The set numerical value appears in the electronic display 26. The input of the numerical value into display 26 does not take place directly as a result of the electrical pulse released on depressing key 25 and instead takes place through the pulse of a photoelectric cell 98, which is arranged in the pivot area of detents 101, 102 pivotable about a spindle 100. A detent 101, 102 or 101', 102' is provided for each of the adjusting slides 83 to 86, as is shown in FIG. 5. They cover one another in the view according to FIG. 9, so that only one pair 101, 102 is visible.

As soon as the adjusting slide has been advanced by one or more teeth 97 by an adjusting push rod 89, 90, the engagement area 103, 104 of the particular stop lever engages in a tooth gap 105, so that the adjusting slides 83 to 86 cannot move back as a result of the tension of a spring 106, which is provided for each slide and engages on the one hand in an opening 107 and on the other on the right hand side of control wheel 17 according to FIG. 5 in a manner not shown. On releasing the adjusting slide, which takes place on erasing the franking values as will be described further hereinafter, the adjusting slides move back into the initial position shown in FIG. 5 due to the tension of springs 106. In this initial position, detents 101, 102, 101', 102' rest on an untoothed area 109 of the adjusting slide, so that the light beam directed onto photoelectric cell 98 is interrupted, while a second photoelectric cell 99, also provided in the pivot area of the stop lever is located in the light beam. FIG. 9 shows the detents 101, 102 in the engaged position, with area 103 engaged in the tooth gap 105 of adjusting slide 84 and area 104 of stop lever 102 in the tooth gap of adjusting slide 85. On again operating a key 25 of the input means 24, adjusting push rod 89 advances the associated adjusting slide by one tooth, area 103 or 104 sliding over the sawtooth-shaped tooth 97, so that stop lever 101, 102 performs a pivoting movement, which leads to a temporary blocking of the photoelectric cell 98. This leads electronically to information being supplied back to the indicator register, corresponding to register 26 of FIG. 1, which advances the previous numerical value by one digit. Thus, a pair of photoelectric cells 98, 99 can electronically determine any position of the two superimposed detents 101, 101' or 102, 102' according to FIG. 9, so that the mechanical movement performed is electronically confirmed. The reliable engagement of the stop lever is ensured by a tension spring 111 which interconnects the legs of the two detents 101, 102. The spindles 100 of detents 101, 102, 101', 102' are fixed to control wheel 17, so that there is a co-rotation of the detents, together with the control wheel and machine shaft 16 during franking. The side view of the control wheel 17 shown on a smaller scale in FIG. 10 makes it possible to see fixing holes 112 for fixing the spindles 100. The area of the detents 101, 102 facing machine shaft 16 is adapted to the shaft shape outside the area of the adjusting slide and engages in a circumferential groove 113 of the shaft, as showwn in FIG. 9, so that the detents are supported in said groove 113 in such a way that there can be no lateral bending out in the shaft direction.

It is obvious that for setting the type wheels, the franking machine shaft 16 must always assume precisely the same rotation position, so that adjusting push rods 89, 90 arranged above and below the shaft and which do not co-rotate, can always be made to precisely engage with the teeth 97 of the associated adjusting slide 83 to 86. The drive of shaft 16 and consequently franking head 4 takes place through the engagement of a driving pinion (not shown) into the toothed rim 115 on the circumference of control wheel 17. This pinion is driven by an electric motor (not shown) until control wheel 17 has performed a 360° revolution. The electric motor driving the pinion is switched off in a conventional manner by a contact switch of a second control wheel (also not shown) at the right hand end of shaft 16. This electrical disconnection does not, however, ensure an exact initial or setting position of shaft 16, so that additionally mechanical means are provided in the form of a cam 116 and a control roller or roll 117. Cam 116 has a recess 118 bounded by two sloping faces, into which moves the control roll 117. Control roll 117 is located at the end of a lever 120 loaded by a spring 119 and which presses the control roll into the recess. As in this rotation position, the drive motor is switched off, the pressure of control roll 117 in this precisely defined recess 118 ensures the rotation position of control wheel 17, corresponding to the zero position, and consequently of shaft 16 with the adjusting slides guided therein.

Figure 10:
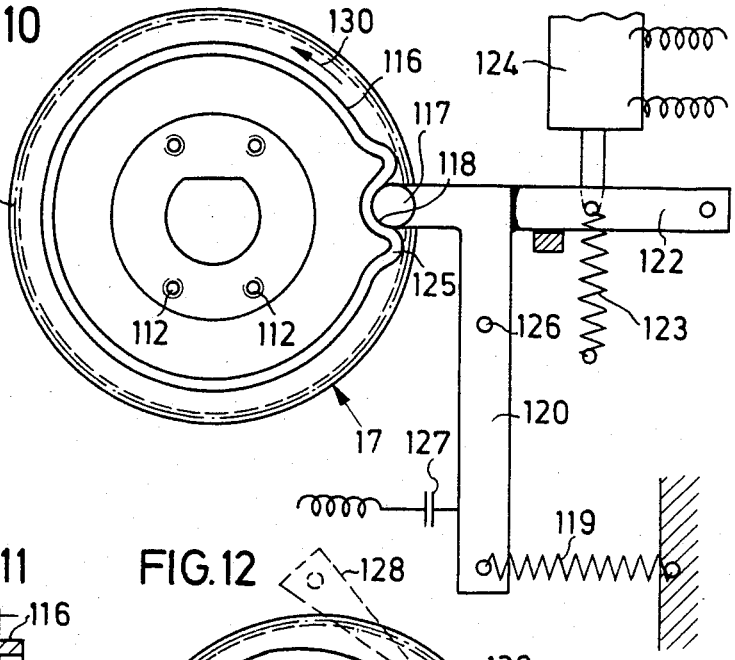
FIG. 10 is a right-hand side elevational view of the control wheel according to FIG. 5 with an engaged zero position stop lever.
Figure 11:
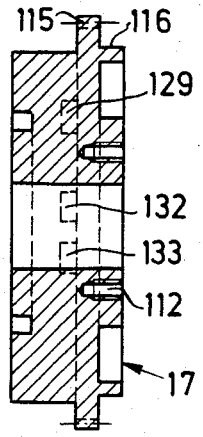
FIG. 11 is an axial sectional view through the control wheel according to FIG. 10.

If the franking machine is not connected to an electrical power supply, the pressing lever 120 of control wheel 17 is secured in the position of FIG. 10 by a retaining pawl 122, by the latter being moved by a spring 123 into the blocking position. However, if the franking machine is connected to a power supply, then an electric magnet 124 draws the retaining pawl onto a release position. On starting the franking machine for printing a franking value, control wheel 17 is driven again, so that control roll 117 moves over the highest point 125 of cam 116 following onto recess 118 and pressing lever 120 is pivoted back about spindle 126 counter to the tension of tension spring 119. As a result of passing beyond this point 125 of cam 116, the previously set franking value displayed in the display register is electrically summated in a counter, in which the consumed value units are stored. This process can electrically be released by a contact switch 127 on the pressing lever, which responds to its pivoting movement.

In order to ensure that after reaching the highest point 125 of cam 116, control roll 117 draws back the control wheel 17 again in that it moves into recess 118, an anti-rebound pawl 128, indicated by broken lines in FIG. 12 is provided, which moves over a ratchet 129 and engages behind the latter in the represented position. The rotation direction of the control wheel is indicated by an arrow 130 in FIGS. 10 and 12. If the control wheel 17 and consequently franking head 4 has moved so far in the direction of arrow 130, that the block rolls over the envelope moving over franking table 6, then the anti-rebound pawl 128 slides over two further ratchets 132, 133 and they prevent the block 8 from being printed several times with the franking value through the reciprocation of the franking head.

Figure 6:
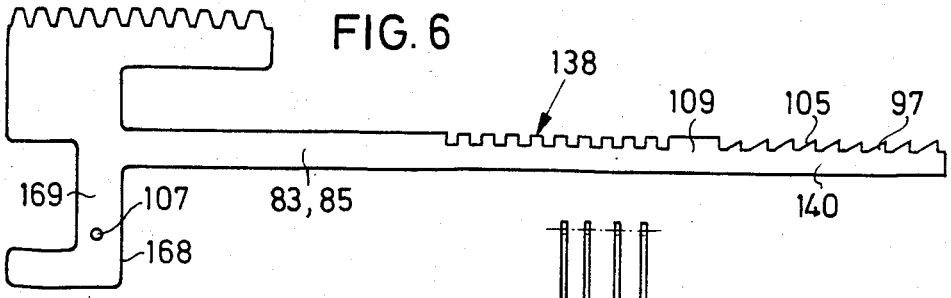
FIGS. 6 and 7 are elevational views of two of the adjusting slides for setting the franking values of the franking machine according to FIG. 5.
Figure 7:
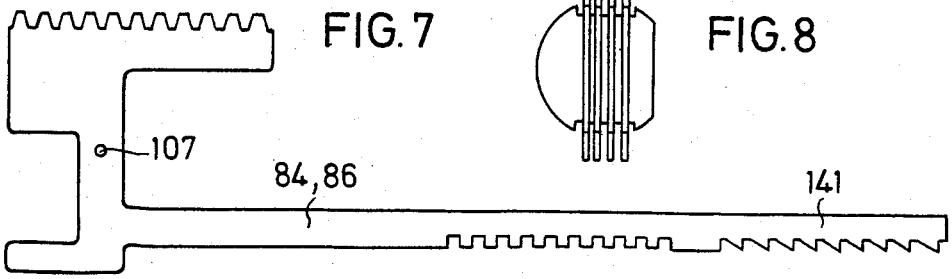
Figure 8:
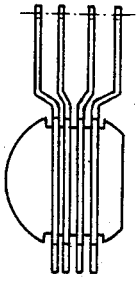
FIG. 8 is an end view of the shaft shown in FIG. 5, as well as the adjusting slides of FIGS. 6 and 7.
Figure 13:
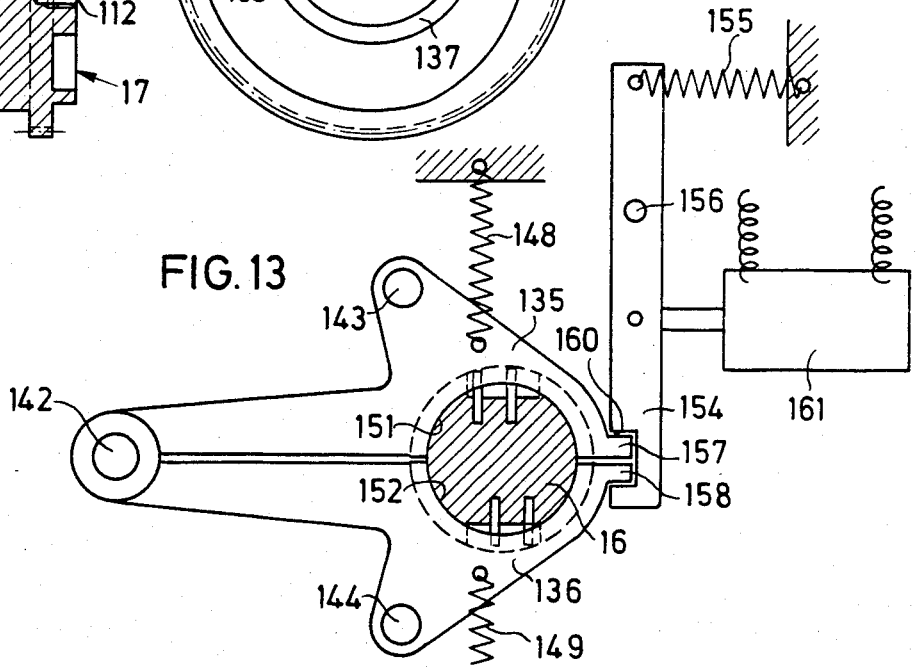
FIG. 13 is a cross-sectional view taken along line XIII—XIII of FIG. 5, with a pair of retaining pawls.

The franking machine also has a device for mechanically blocking the franking value, which is set by the displaceement of adjusting slides 83 to 86. This blocking device comes into action as soon as shaft 16 has rotated by a small angle and is only freed again, when the set franking value has again been erased. For this purpose, two retaining pawls 135, 136 are provided, which engage in tooth gaps 137 of rectangular teeth 138 of adjusting slides 83 to 86 and which in FIGS. 5 and 13 are in engagement with a tooth gap 137. As is also shown by FIGS. 6 and 7, these rectangular teeth 138 are arranged in the longitudinal direction of the adjusting slides behind the row of teeth 97 and the tooth-free area 109. Each retaining pawl 135, 136 is used for stopping a similarly shaped adjusting slide 83, 85 or 84, 86, in that the pawl 135 engages in the rectangular toothing 138 of slides 83, 85 and pawl 136 engages in the rectangular teeth of slides 84, 86. In each case, there are two adjusting slides according to FIGS. 6 and 7, whose teeth in the slide part 140, 141 extending through shaft 16, pass away in opposite directions from the shaft axis, because they are provided for the adjustment of adjusting push rods 89, 90 arranged on opposite sides of shaft 16, as also applies with regard to the detents 101, 102 according to FIG. 9. Pawls 135, 136 unlike in the case of detents 101, 102 do not rotate with control disk 17 and are instead pivotably mounted about a common fixed spindle 142 in a wall of the machine casing. Each pawl 135, 136 has a control pin 143, 144, which are guided in a control slot 137, which is positioned to the left of control wheel 17 in FIG. 5 and whose configuration is shown in FIG. 12. In the rotation position shown in FIG. 12, the shaft 16 and control wheel 17, in which adjusting slides 83 to 86 face their associated adjusting push rods 89, 90, the control pins 143, 144 of the retaining pawls are located in their radially outermost position, because in this rotation position control slot 137 has bulges 145, 146. In this radially outermost position of the control pins, the pawls 135, 136 are not in engagement with the rectangular teeth 138, so that the adjusting push rods 89, 90 can advance the adjusting slides in the direction of arrow 147. In each case, one tension spring 148, 149 pulls the pawls 135, 136 apart and consequently into the bulges 145, 146 of control slot 137. If the control disk rotates control pins 143, 144 and consequently pawls 135, 136, with respect to the machine shaft 16, are drawn radially inwardly into the particular tooth gap 137 corresponding to the setting position of the adjusting slides, as well as into a circular slot 150 of shaft 16. The engagement edge 151, 152 of the pawls is correspondingly made arcuate. As a result of this engagement of the pawls in slot 150, they are prevented from bending out in the direction of shaft 16. Pawls 135, 136 are locked in the engagement position by a locking lever 154, which is pivoted by a tension spring 155 about a fixed spindle 156 into the engagement position with the pawls, where two extensions 157, 158 of the latter are held in a recess 160 of locking lever 154. On rotating shaft 16, pawls 135, 136 remain in the locking position shown in FIGS. 5 and 13, so that the set franking value is kept the same for several franking operations. Only after initiating the erasing process for the set franking value does the locking lever 154 again release pawls 135, 136, in that an electromagnet 161 pivots back locking lever 154 counter to the tension of spring 155. In the setting position of shaft 16, the pawls 135, 136 can be moved apart again through the tension of springs 148, 149, in order to permit a new setting of the type wheels or of franking values.

For erasing the set franking value, detents 101, 102, 101', 102' must be disengaged from the teeth 97 of adjusting slides 83 to 86, for which purpose a release lever 163 is provided which, by means of an electromagnet 164, is pressed against a lever arm 165, 166 of detents 100, 102, so that the latter can pivot outwardly about spindle 100 counter to the tension of tension spring 111. After releasing the adjusting slides 83 to 86, the tension springs 106 provided on each of these slides draws the slides back into their initial position, i.e. to the right in FIG. 5 until they reach the position shown there. Edge 168 on head part 169 of the adjusting slides engages with the end face 170 of machine shaft 16.

As soon as a setting key, corresponding to key 25 according to FIG. 1, has been depressed for setting a franking value, the detents 101, 102 are optically read by means of photoelectric cells 98, 99, to establish whether all the racks are in the initial or zero position. If this is not the case, the erasure process is started, i.e. electromagnets 161 and 164 are operated, in order to release pawls 135, 136 and detents 101, 102.

FIG. 5 shows one of the two bearings 172, which is connected to an inner casing wall 173 of the franking machine by means of screws 174. With the exception of bearing 172, pawls 135, 136 and adjusting push rods 89. 90, all the parts shown in FIG. 3 rotate with shaft 16 during franking. Photoelectric cells 98, 99 of FIG. 9 are fixed, because the optical reading of the position of detents 101, 102 only takes place when shaft 16 is in the setting position.

It is a particular advantage of the invention that several identically constructed setting mechanisms 14, 14' can be used on one franking machine, so that mass production is greatly simplified. In the described embodiment, in each case one setting mechanism 14, 14' with in each case two adjusting push rods 30, 32, 30', 32' are provided on either side of the franking head for setting the date or for adjusting block 10. For setting the franking value or for adjusting block 10, on two diametrically facing sides of shaft 16 are provided in each case one setting mechanism with in each case two adjusting push rods 89. 90 fixed to a casing wall, so that there are in all four setting mechanisms with a total of eight adjusting push rods.

While specific embodiments of the invention have been shown and described in detail to illustrate the application of the principles of the invention, it will be understood that the invention may be embodied otherwise without departing from such principles.

What is claimed is:

1. A setting mechanism for a printing device having a plurality of rotatably mounted type wheels each with a pinion connected thereto, comprising:

a support;

at least one push rod associated with one of the pinions, mounted for reciprocal movement to said support for rotating the one pinion by an incremental amount in stepwise fashion to change a type on the type wheel connected to the one pinion during each reciprocation;

an electromagnet connected to said support and having a movable part engaged with said at least one push rob for reciprocally moving said at least one push rod;

said support including a fixed part and a guide plate pivotally mounted to said fixed part, said at least one push rod mounted for reciprocal movement on said guide plate; and an additional electromagnet connected to said fixed part and engageable with said guide plate for moving said guide plate between a first position in which said at least one push rod is effective to move the one pinion, and a second position wherein reciprocal movement of said push rod has no effect on the one pinion.

2. A setting mechanism according to claim 1, wherein said guide plate has at least one upwardly bent part and at least one guidance cutout for guiding said at least one push rod in its reciprocal motion.

3. A setting mechanism according to claim 1, including a plurality of push rods each associated with a different pinion, said guide plate defining a guide path for each push rod for guiding each push rod in reciprocal linear motion.

4. A setting mechanism according to claim 3, including an electromagnetic for each push rod connected to said support, each electromagnet having a movable part engaged with a respective one of said push rods for selectively reciprocally moving each one of said push rods.

5. A setting mechanism for a franking machine having a plurality of rotatably mounted value type wheels each with a pinion connected thereto, comprising:

a support;

a plurality of push rods each associated with a separate one of the pinions, and each mounted for reciprocal movement to said support for rotating a separate pinion by an incremental amount in stepwise fashion to change a type on the type wheel connected to the separate pinion during each reciprocation;

an electromagnet connected to said support and having a movable part engaged with one of said at least one push rods for reciprocally moving said one push rod;

a rack for each push rod, each rack having a first set of teeth adapted for engagement with a separate one of the pinions, and a second set of teeth, each push rod engageable with said second set of teeth for linearly moving one rack to incrementally rotate the separate pinion;

a casing forming a part of said franking machine;

a shaft rotatably mounted to said casing for carrying the plurality of value type wheels, each rack slidably mounted on said shaft with said second set of teeth defined on a portion of each rack facing outwardly of said shaft, said support being mounted to said casing;

a retaining pawl movably mounted to said casing, each rack having a third set of teeth which are rectangular, said retaining pawl movable from a locking position in one of said rectangular teeth to an unlocking position out of said rectangular teeth and means connected between said shaft and said retaining pawl for moving said retaining pawl with rotation of said shaft between said locking and unlocking positions;

a locking member movably mounted to said casing and engageable with said retaining pawl for locking said retaining pawl in said locking position; and an additional electromagnet connected to said casing having a movable part engaged with said locking member for disengaging said locking member from said retaining pawl for permitting movement of said retaining pawl into said unlocking position.

6. A setting mechanism for franking machine having a plurality of rotatably mounted value type wheels each with a pinion connected thereto, comprising:

a support;

a plurality of push rods each associated with a separate one of the pinions, and each mounted for reciprocal movement to said support for rotating a separate pinion by an incremental amount in stepwise fashin to change a type on the type wheel connected to the separate pinion during each reciprocation;

an electromagnet connected to said support and having a movable part engaged with one of said at least one push rods for reciprocally moving said one push rod;

a rack for each push rod, each rack having a first set of teeth adapted for engagement with a separate one of the pinions, and a second set of teeth, each push rod engageable with said second set of teeth for linearly moving one rack to incrementally rotate the separate pinion;

a casing forming a part of said franking machine;

a shaft rotatably mounted to said casing for carrying the plurality of value type wheels, each rack slidably mounted on said shaft with said second set of teeth defined on a portion of each rack facing outwardly of said shaft, said support being mounted to said casing;

each rack having said first set of teeth engaged with one of the pinions and a second set of teeth engageable with one of said push rods, said second set of teeth each having a sawtooth shape;

a detent movably mounted to said casing for moving from an engagement position to a disengagement position, said detent in said engagement position engaging a tooth of said second set of teeth for holding each rack in a fixed position;

a recovery spring connected to each rack for returning each rack to a neutral position;

a further electromagnet connected to said casing and having a movable part engaged with said detent for moving said detent between said engagement and disengagement position;

a retaining pawl movably mounted to said casing;

each rack having a third set of teeth which are rectangular, said retaining pawl movable from a locking position in one of said rectangular teeth to an unlocking position out of said rectangular teeth;

means connected between said shaft and said retaining pawl for moving said retaining pawl with rotation of said shaft between said locking and unlocking positions;

a locking member movably mounted to said casing and engageable with said retaining pawl for locking said retaining pawl in said locking position; and an additional electromagnet connected to said casing having a movable part engaged with said locking member for disengaging said locking member from said retaining pawl for permitting movement of said retaining pawl into said unlocking position.

7. a setting mechanism for a franking machine having a plurality of rotatably mounted value type wheels each with a pinion connected thereto, comprising:

a support;

a plurality of push rods each associated with a separate one of the pinions, and each mounted for reciprocal movement to said support for rotating a separate pinion by an incremental amount in stepwise fashion to change a type on the type wheel connected to the separate pinion during each reciprocation;

an electromagnet connected to said support and having a movable part enngaged with one of said at least one push rods for reciprocally moving said one push rod;

a rack for each push rod, each rack having a first set of teeth adapted for engagement with a separate one of the pinions, and a second set of teeth, each push rod engageable with said second set of teeth for linearly moving one rack to incrementally rotate the separate pinion;

a casing forming a part of said franking machine;

a shaft rotatably mounted to said casing for carrying the plurality of value type wheels, each rack slidably mounted on said shaft with said second set of teeth defined on a portion of each rack facing outwardly of said shaft, said support being mounted to said casing;

each rack having said first set of teeth engaged with one of the pinions and a second set of teeth engageable with one of said push rods, said second set of teeth each having a sawtooth shape;

a detent movably mounted to said casing for moving from an engagement position to a disengagement position, said detent in said engagement position engaging a tooth of said second set of teeth for holding each rack in a fixed position;

a recovery spring connected to each rack for returning each rack to a neutral position;

a further electromagnet connected to said casing and having a movable part engaged with said detent for moving said detent between said engagement and disengagement positions;

a loading spring connected to said detent for holding said detent in said engagement position;

said further electromagnet operable to move said detent into said disengagement position for permitting movement of said racks into each neutral position under the influence of each recovery spring;

photoelectric means connected to said casing and positioned to detent when said detent is in said engagement and said disengagement positions; and counting and display means connected to said photoelectric means for counting and displaying a position change of said detent.

8. In a printing device having a plurality of printing type wheels rotatably mounted in a rotatable printing head and each with a pinion connected thereto, a setting mechanism comprising:

a support;

at least one push rod associated with one of the pinions, mounted for reciprocal movement to said support for rotating the one pinion by an incremental amount in stepwise fashion to change a type on the type wheel connected to the one pinion during each reciprocation;

an electromagnet connected to said support and having a movable part engaged with said at least one push rod for reciprocally moving said at least one push rod;

said support including a fixed part and guide means mounted to said fixed part, said at least one push rod mounted for reciprocal movement on said guide means; and additional means connected to said fixed part and cooperating with said guide means for moving said at least one push rod between a first position in which said at least one push rod is effective to move the one pinion, and a second position wherein reciprocal movement of said push rod has no effect on the one pinion.

9. In a printing device a setting mechanism according to claim 8, wherein said at least one push rod is adapted to directly engage teeth of the one pinion.

10. In a printing device a setting mechanism according to claim 8, wherein said support includes a fixed part and a guide plate pivotally mounted to said fixed part, said at least one push rod mounted for reciprocal movement on said guide plate and an additional electromagnet connected to said fixed part and engageable with said guide plate for moving said guide plate between a first position in which said at least one push rod is effective to move the one pinion, and a second position wherein reciprocal movement of said push rod has no effect on the one pinion.

11. In a printing device a setting mechanism according to claim 8, including a rack having a first set of teeth adapted for engagement with the one pinion and a second set of teeth, said at least one push rod engageable with said second set of teeth for linearly moving said rack to incrementally rotate the one pinion.

12. In a printing device a setting mechanism according to claim 11, wherein the printing device comprises a franking machine, each type wheel comprises a value type wheel, a plurality of push rods supported for reciprocal movement on said support each associated with a separate pinion of a separate value type wheel, a casing forming a part of said franking machine, a shaft rotatably mounted to said casing for carrying the plurality of value type wheels, each rack slidably mounted on said shaft with said second set of teeth defined on a portion of each rack facing outwardly of said shaft, said support being mounted to said casing.

13. In a printing device a setting mechanism according to claim 12, including a second support connected to said casing, at least one second push rod associated with another pinion on another value type wheel mounted for reciprocal movement on said second support, a second electromagnet connected to said support having a second movable part engaged with said at least one second push rod for reciprocating said at least one second push rod, at least one second rack slidably mounted to said shaft on a circumferentially opposite position with respect to said aforementioned racks, said additional rack having a first set of teeth engaged with the other pinion and a second set of teeth engageable by said at least one second push rod.

14. In a printing device a setting mechanism according to claim 12, including a retaining pawl movably mounted to said casing, each rack having a third set of teeth which are rectangular, said retaining pawl movable from a locking position in one of said rectangular teeth to an unlocking position out of said rectangular teeth and means connected between said shaft and said retaining pawl for moving said retaining pawl with rotation of said shaft between said locking and unlocking positions.

15. In a printing device a setting mechanism according to claim 12, wherein said franking machine includes a plurality of date type wheels for indicating a date, each date type wheel having a pinion connected thereto, a second support connected to said casing, at least one second push rod associated with one of the pinions of the date type wheels, reciprocally mounted for movement on said second support for engaging the one pinion of the one date type wheel for incrementally rotating the one pinion of the one date type wheel in stepwise fashion, and a second electromagnet connected to said support having a movable part engaged with said at least one second push rod for reciprocally moving said at least one push rod.

16. In a printing device a setting mechanism according to claim 12, wherein each of said racks has said first set of teeth engaged with one of the pinions and a second set of teeth engageable with one of said push rods, said second set of teeth each having a sawtooth shape, a detent movably mounted to said casing for moving from an engagement position to a disengagement position, said detent in said engagement position engaging a tooth of said second set of teeth for holding each rack in a fixed position, a recovery spring connected to each rack for returning each rack to a neutral position, and a further electromagnet connected to said casing and having a movable part engaged with said detent for moving said detent between said engagement and disengagement positions.

17. In a printing device a setting mechanism according to claim 16, including a loading spring connected to said detent for holding said detent in said engagement position, said further electromagnet operable to move said detent into said disengagement position for permitting movement of said racks into each neutral position under the influence of each recovery spring.

18. In a printing device setting mechanism according to claim 17, including photoelectric means connected to said casing and positioned to detect when said detent is in said engagement and said disengagement positions.

* * * * *